United States Patent [19]

Bassett, Jr. et al.

[11] 4,014,686

[45] Mar. 29, 1977

[54] DEOXIDATION OF OPEN TYPE STEELS FOR IMPROVED FORMABILITY

[75] Inventors: James G. Bassett, Jr., Franklin Township, Westmoreland County; Saul Gilbert, Pittsburgh, both of Pa.

[73] Assignee: United States Steel Corporation, Pittsburgh, Pa.

[22] Filed: Feb. 23, 1976

[21] Appl. No.: 660,568

[52] U.S. Cl. ..... 75/58; 75/53

[51] Int. Cl.[2] ..... C21C 7/02

[58] Field of Search ..... 75/53, 58

[56] References Cited

UNITED STATES PATENTS

| | | | |
|---|---|---|---|
| 3,754,893 | 8/1973 | Frawley | 75/58 |
| 3,801,303 | 4/1974 | Kotler | 75/58 |
| 3,885,956 | 5/1975 | Obst | 75/58 |

*Primary Examiner*—Peter D. Rosenberg
*Attorney, Agent, or Firm*—Arthur J. Greif

[57] ABSTRACT

A method is disclosed for the deoxidation of open type steels, e.g. rimmed and capped steels, which are particularly useful in the production of sheet products with improved formability. The requisite amount of deoxidation in the ladle is achieved through the use of conventional deoxidizers, other than aluminum (preferably silicon carbide). Deoxidation in the mold is also achieved without the use of aluminum. Here, however, it is necessary that mold deoxidation be achieved through the use of magnesium, generally added in the form of a magnesium-nickel alloy.

9 Claims, No Drawings

DEOXIDATION OF OPEN TYPE STEELS FOR IMPROVED FORMABILITY

This invention relates to the production of steel strands (sheet or strip) with improved formability and is more particularly related to a method for the deoxidation of the "open" type ingots (rimmed, capped and semikilled) which are employed as precursors for the production of said steel strands.

In general, the steel strands which have been employed for the production of drawn and ironed cans have been produced by comparatively expensive processes such as a rimmed stabilization practice, see for example U.S. Pat. No. 3,754,591 or by continuous casting such as shown in U.S. Pat. No. Re 27,447. Sheet product manufactured from ingots produced by the foregoing methods is generally more expensive than similar sheet produced from "open"-type steels, because of the higher ingot product yield obtainable from the latter method. Unfortunately, the use of lower cost rimmed or capped steels for the production of drawn and ironed cans has generally resulted in unsatisfactory performance, particularly connected with a decided tendency to develop cracks during the flanging operation. Cracked flanges are undesirable since they prevent a proper seal between the top and the body of the can.

In the manufacture of open steels intended for container applications, precise control of the oxygen content is generally maintained so as to achieve a proper rimming action and thereby produce a desirable surface condition on the slabs that are to be rolled from the ingots. To achieve this rimming action, the oxygen content of the steel is therefore deliberately permitted to remain at a high level in the furnace at tap. The desired degree of rimming action is therefore conventionally controlled by the addition of small quantities of aluminum both in the ladle and in the mold to lower the oxygen content to the desired degree. Generally the amount of aluminum added is determined on a trial-and-error basis so as to achieve proper action for the production of a flat rim — neither rising (underoxidized) nor sinking (over-oxidized) — which is particularly important for achieving good product surface quality.

Previous work had suggested that potential areas for the causation of the undesirable flange cracking were cites of manganese-aluminate inclusions and/or iron carbide inclusions. In view thereof, experiments were undertaken to modify the conventional aluminum deoxidation practice (employing a process somewhat analogous to that shown in U.S. Pat. No. 3,754,893) in which a magnesium-nickel alloy was used in place of aluminum to control the rimming action of the steel in the mold. Although steels produced by this latter method showed a decided improvement in flange-cracking performance, the tendency to cracking nevertheless remained at an undesirable level.

It is therefore a principle object of this invention to provide a method for the deoxidation of "open" type steels, which method is capable of producing sheet product equivalent to, or even superior in performance to steel produced by the above-noted more expensive (rim-stabilization or continuous casting) practices.

This and other objects of the invention will become more apparent from a reading of the following description when read in conjunction with the appended claims.

Table I, below, summarizes the results of three separate heats which were produced to determine the effect of eliminating ladle aluminum and/or mold aluminum on the flangability (formability) of the sheet steel produced therefrom. In the first heat (R476) aluminum was added to the ladle as a deoxidizer, and seven of the twelve ingots produced therefrom were treated with aluminum at a rate of 1¾ ounces/ton. The other five of the 12 ingots were treated in the mold with from 4.4 to 5.5 ounces/ton of a 15 Mg—85 Ni alloy. This represented the addition 0.66 to 0.88 ounces of magnesium/-ton of steel. In the second heat (R798), the ladle aluminum addition was replaced with 100 lbs. (8 oz./ton) of silicon carbide. Seven of the 12 ingots produced therefrom were treated with 1½ ounces of aluminum/ton of steel. The other five ingots were treated with 11.8 ounces of the nickel-magnesium alloy/ton of steel. This represented the addition of 1¾ ounces of magnesium per ton of steel. These experimental ingots were processed in conventional manner and samples were obtained from the resultant black-plate coils after temper rolling. Samples were also obtained from coils of a conventional-type MR steel (control).

Approximately 10 drawn and ironed cans were produced from a coil segment representing each of the individual coils (the number of such individual coils per run is noted in in parenthesis in Table I). For the initial evaluation of the tendency to flange cracking, these cans were flanged utilizing a laboratory-type flanger. The results of these laboratory flanging tests are provided in Table I. For the heats which were deoxidized utilizing what may be termed conventional practice, i.e. in which aluminum is added both in the ladle and in the mold (runs 1 and 6), greater than 80% of the flanges exhibited cracking. The silicon carbide substitution for ladle aluminum, with aluminum in the mold (run 3), gave a product for which cracked flanges decreased to 52%. Utilizing a prior-art method in which aluminum was employed for ladle deoxidation, but in which magnesium was substitued for aluminum in the mold, the percentage of cracked flanges decreased to 13% (Run No. 2). By comparison, when silicon carbide replaced the aluminum in ladle and magnesium was employed in the mold, the percentage cracked flanges further decreased to only 4% (Runs 4 and 5). The latter degree of flange cracking compares quite favorably with that of steels produced utilizing the above noted more expensive practices — i.e., continuous casting or rim-stabilization techniques.

Table I

| Results of Laboratory Flangeability Tests | | | | | |
|---|---|---|---|---|---|
| Heat No. | Run No. | Ladle Addition | Mold Addition | | Percent of Cans With Cracked Flanges |
| | | | Experimental Type MR Steels | | |
| R476 | 1 | Aluminum (100 lb) | Aluminum (2 lb/ingot) | (3 coils) | 89 |
| R476 | 2 | Aluminum (100 lb) | Nickel-magnesium (6¼ lb/ingot) | (6 coils) | 13 |
| R798 | 3 | Silicon carbide | Aluminum | (6 coils) | 52 |

Table I-continued

| Heat No. | Run No. | Results of Laboratory Flangeability Tests: Ladle Addition | Mold Addition | | Percent of Cans With Cracked Flanges |
|---|---|---|---|---|---|
| | | (100 lb) | (1¾ lb/ingot) | | |
| R798 | 4 | Silicon carbide (100 lb) | Nickel-magnesium (12 lb/ingot) | (2 coils) | 3 |
| R798 | 5 | Silicon carbide (100 lb) | Nickel-magnesium (14 lb/ingot) | (8 coils) | 4 |
| | | | Conventional Type MR Steel (Control) | | |
| R721 | 6 | Aluminum (50 lb) | Aluminum (2 lb/ingot) | (4 coils) | 81 |

On the basis of these laboratory flangeability tests, three coils of the above steels were further evaluated for drawability and flangeability at a commercial can making facility. Two of the coils were processed from the run with silicon carbide in the ladle and nickel-magnesium in the mold (Run No. 5). Since the run with Al in the ladle and Mg in the mold showed some promise in the laboratory evaluation, the third coil evaluated under these commercial conditions was processed from Run No. 2. When processed to D&I cans, the triplate of all three coils exhibited excellent drawing and ironing performance and was substantially free from the tendency towards flange cracking. The two coils with silicon carbide in the ladle and magnesium in the mold resulted in less than 0.02 percent of the cans exhibiting either flange cracks or wrinkling. The coil with aluminum in the ladle and magnesium in the mold showed about three times that number of unsatisfactory cans.

The steels of this invention may therefore be produced in the following preferred manner. Although the deoxidation method described herein may, in general, be utilized for the production of low-carbon "open" type steels, i.e. steels having a carbon content below about 0.4%; it is especially applicable to the production of rimmed or capped ingot steels having a carbon content below 0.15%. When the latter steels are used for the manufacture of sheet products useful for the production of can stock, virtually all such sheet products will have a composition consisting essentially of carbon, 0.02–0.15%; magnanese, 0.20–0.60%; phosphorus, 0.15 max.; sulfur, 0.05 max.; silicon, 0.01 max.; and copper, 0.20 max. During the tapping of the steel from the furnace, magnanese will conventionally be added in the ladle to meet specification. At this point, the instant invention departs from conventional procedure — i.e., in which aluminum is added to lower the oxygen level of the heat. Thus, in accord with the teachings herein, it is essential that other deoxidizers such as silicon, ferrosilicon, calcium-silicon, or silicon carbide, be utilized in place of aluminum. It is desirable that the ladle deoxidizer contain a major portion of SiC. Preferably, the SiC will be substantially devoid of other deoxidizers. Although it is preferable that the ladle deoxidizers be essentially free (i.e. < 1% of the total amount) of Al, the benefits of this invention will nevertheless be realized if these deoxidizers are substantially devoid (i.e., in which the amount present is less than 10% of the total) of aluminum. Of course, it is also desirable that the residual level of Al, at tap, be kept to a minimum, so that the insoluble aluminum content of the strand product will be less than 0.001%, preferably less than 0.0007%. As in conventional aluminum deoxidation practice, the amount of deoxidizer added will be a function of the oxygen content of the steel. Thus, the oxygen contents of these steels will normally range about 200 to 1200 ppm, depending to a large extent on the tap carbon content. The amount of deoxidizer added will, in general, vary approximately directly with the oxygen content. Thus, when silicon carbide is employed as the principle ladle deoxidant, it will be employed in amounts up to 1.5 lbs/ton of steel. Subsequent to the partial deoxidation in the ladle, the metal is teemed into the mold, during which a deoxidizer consisting essentially of magnesium is added to control the rimming action. The preferred rimming action is a flat rim, neither rising nor sinking. However, in actual practice a slightly dropping metal level in the mold (slight over-oxidation) is also considered acceptable for achieving good product surface quality. Depending on the tap oxygen content and the amount of deoxidizer added in the ladle, such proper action will be realized by the addition of magnesium in an amount of from 1 to 10 oz/ton, and more generally from 1 to 3 oz/ton. This notwithstanding, the benefits of this invention, as to enhanced formability, may nevertheless be achieved in significantly under-oxidized steels (but with some sacrifice in surface quality) by the addition of as little as 0.5 oz./ton of magnesium. While it is preferable to add the magnesium in the form of a magnesium-nickel alloy (generally containing less than 0.3 parts magnesium) the magnesium may nevertheless be added by any of the methods, well known for the addition thereof, such as those described in U.S. Pat. No. 2,988,444.

We claim:

1. In the manufacture of low carbon steel strands, wherein the precursor molten steel therefor is produced by "open" methods, in which the desired degree of mold rimming action is controlled by the addition of deoxidizers to the molten steel, both in the ladle and in the mold, a method for improving the formability of said steel strands, in which the deoxidation in the ladle is effected by the addition of deoxidizers substantially devoid of Al and wherein the deoxidizer added to the mold consists essentially of Mg in an amount of 0.5 to 10 oz./ton of steel.

2. The method of claim 1, wherein the composition of said steel strands consists essentially of,

| | |
|---|---|
| C | 0.02–0.15 |
| Mn | 0.20–0.60 |
| P | 0.15 max. |
| S | 0.050 max. |
| Si | 0.010 max. |
| Cu | 0.20 max. |
| Al (insoluble) | 0.001 max. |

3. The method of claim 2, in which a major portion of said ladle deoxidizer is SiC.

4. The method of claim 3, in which said Mg is added in the form of Mg—Ni alloy, said alloy containing less than 30% Mg.

5. The method of claim 4, in which the amount of Mg added is at least 1.0 oz/ton.

6. The method of claim 5, in which the amount of Mg added is less than 3.0 oz/ton.

7. The method of claim 6, in which the deoxidizers employed for said ladle deoxidation are essentially free of Al.

8. The method of claim 7, in which the insoluble Al content of said steel strand is less than 0.0007%.

9. The method of claim 8, in which said SiC is substantially devoid of other deoxidizers.

* * * * *